United States Patent [19]

Nitta

[11] Patent Number: 4,776,491

[45] Date of Patent: Oct. 11, 1988

[54] PORTABLE AEROSOL CONTAINER

[75] Inventor: Tomio Nitta, Yokohama, Japan

[73] Assignee: Tokai Corporation, Kanagawa, Japan

[21] Appl. No.: 90,072

[22] Filed: Aug. 27, 1987

[30] Foreign Application Priority Data

Sep. 16, 1986 [JP] Japan ..... 61-141612[U]

[51] Int. Cl.[4] ..... B65D 83/14; B67D 5/32

[52] U.S. Cl. ..... 222/153; 222/402.11

[58] Field of Search ..... 222/153, 182, 41, 402.11, 222/402.12, 402.13; 215/330

[56] References Cited

U.S. PATENT DOCUMENTS

| | | | |
|---|---|---|---|
| 2,715,481 | 8/1955 | McGhie et al. | 222/153 |
| 2,752,066 | 6/1956 | Ayres | 222/402.11 X |
| 3,306,497 | 2/1967 | Kenney et al. | 222/182 |
| 3,474,939 | 10/1969 | O'Donnell et al. | 222/402.11 X |
| 3,484,023 | 12/1969 | Meshberg | 222/402.11 |
| 3,739,941 | 6/1973 | Ostrwosky et al. | 222/153 |
| 3,827,605 | 8/1974 | Knickerbocker | 222/153 |
| 4,162,746 | 7/1979 | Anderson et al. | 222/153 |
| 4,620,646 | 11/1986 | Crapser | 222/153 |
| 4,676,408 | 6/1987 | Speitel | 222/183 |

FOREIGN PATENT DOCUMENTS

| | | | |
|---|---|---|---|
| 2214135 | 10/1973 | Fed. Rep. of Germany | 222/402.11 |

*Primary Examiner*—Kevin P. Shaver

*Attorney, Agent, or Firm*—Armstrong, Nikaido, Marmelstein & Kubovcik

[57] ABSTRACT

A portable, fail-safe aerosol container comprising an elongated tank body having an ejection nozzle head to be depressed for dispensing a spray of aerosol, an elongated guard rotatably fixed to the top of the tank body about the ejection nozzle head having slots on each of its long sides for alignment with the ejection nozzle on the nozzle head and a lock for preventing depression of the ejection nozzle head when the guard is in alignment with the tank body and permitting depression of the ejection nozzle head when the guard is turned to lie across the aerosol container with a slot on either of the long sides of the guard in alignment with the ejection nozzle.

1 Claim, 2 Drawing Sheets

PORTABLE AEROSOL CONTAINER

BACKGROUND OF THE INVENTION

1. Field of the Invention

The present invention relates to a portable or handy-to-carry aerosol container equipped with safety means for preventing undesired ejection of aerosol.

2. Related Art

A conventional portable, fail-safe aerosol container has a circular guard around an ejection head, thereby allowing the ejection head to be depressed for forcing out aerosol in a fine mist only when the guard is turned to a predetermined position.

The guard is circular in shape, and therefore from the appearance of the guard it is difficult to determine whether the aerosol container is locked or not. In this connection the aerosol container inadvertently remains unlocked often, and disadvantageously undesired ejection of aerosol is apt to occur.

SUMMARY OF THE INVENTION

One object of the present invention is to provide a portable, fail-safe aerosol container which takes different forms to show in which position the aerosol container is, locked or unlocked, thereby guaranteed free of inadvertent ejection of aerosol.

To attain this object a portable or handy-to-carry, fail-safe aerosol container according to the present invention comprises: a tank body having, in cross-section, a shape of elongated polygon or oval having relatively long and short cross-axes; an ejection nozzle head having an ejection nozzle built therein and a lock recess opening on the bottom surface thereof, the ejection nozzle being directed normal to the long axis of the shape of the tank body; an aerosol ejection stem having a longitudinal channel made therein, being fixed to the ejection nozzle and being slidably fixed to the top of the tank body and spring-biased upward, the aerosol ejection stem, when depressed into the aerosol container, causing an associated valve to open for supplying aerosol to the ejection nozzle; a guard having the same shape and size in cross-section as the tank body, the guard being rotatably fixed to the top of the tank body about the ejection nozzle head, having a slot on each long side and a lock projection rising up to the bottom surface of the ejection nozzle head at such a position that the lock projection may be brought in alignment with the lock recess of the ejection nozzle head when the guard is turned to lie across the tank body with either of the opposite slots in alignment with the ejection nozzle, thereby permitting depression of the ejection nozzle head, and hence depression of the aerosol ejection stem until the associated valve has opened for forcing out aerosol from the ejection nozzle in a fine mist.

With this arrangement the guard will lie across the aerosol container when the aerosol container can force out aerosol in a fine mist, and the guard will lie in alignment with the tank body when the aerosol container cannot eject aerosol. Thus, at first sight it can be readily determined in which position the aerosol container is, locked or unlocked.

Other objects and advantages of the present invention will be understood from a sole embodiment of the present invention, which is shown in the accompanying drawings:

PREFERRED EMBODIMENT OF THE INVENTION

Figure 1:
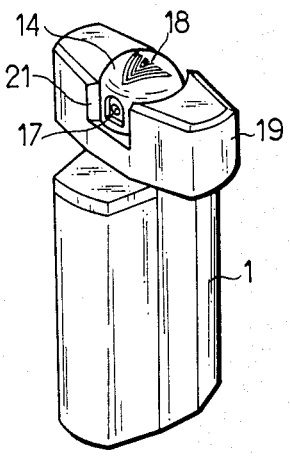
FIG. 1 is perspective view of a portable fail-safe aerosol container according to the embodiment of the present invention in a position in which it can force out aerosol in a fine mist.

Referring to the drawings, a portable aerosol container has a tank body 1 having, in cross section, a rectangular or oval shape. This figure has relatively long and short cross axes.

As shown, a valve 2 is provided to the center of the top of the tank body 1, and a dip tube 3 extends down from the valve 2. The valve 2 is used for controlling supply of aerosol from the tank body. The valve 2 has a valve box 4 descending from the ceiling of the tank body 1, and the box 4 has a straight-and-divergent hole to provide a valve chamber 5.

An aerosol ejection stem 6 is slidably inserted in the valve chamber 5. The aerosol ejection stem 6 has longitudinal channel 7 made therein and a lateral channel 8 made in the vicinity of the bottom of the longitudinal channel for communicating the longitudinal channel with the valve chamber 5. The stem 6 has an annular recess 9 at the level at which the lateral channel or valve inlet 8 opens. A valve body 10 of rubber is fitted in the annular recess 9 to shut the valve inlet 8 all the time. The depression of the stem will cause the valve body 10 to yieldingly bend, thereby opening the valve inlet 8. As shown, a ring valve retainer 11 is fitted around the stem 6, and is threadedly engaged with the open end of the valve box 4 to push the valve body 10 against the shoulder 4A of the valve box in an air tight fashion. A spring 12 is provided in the valve box 4 to push up the stem 6 all the time. A hole 13 is made in the bottom of the valve box 4, and a dip tube 3 is inserted in the hole 13, descending in the inside of the aerosol container 1.

An ejection nozzle head 14 is fixed to the top end of the aerosol ejection stem 6. Specifically, the ejection nozzle head 14 has a longitudinal recess 15 made in the skirt 14A of the head 14, and the tank body 1 has an elongated projection 16 rising from the top edge of the container 1. The ejection nozzle head 14 is put on the aerosol ejection stem 6 with the elongated projection 16 of the container fitted in the longitudinal recess 15 of the head 14, thereby preventing rotation of the head about the stem.

The ejection nozzle head 14 is circular in cross-section, and it has an ejection nozzle 17 built therein. The ejection nozzle 17 is directed along the long axis of the tank body 1. The top surface of the ejection nozzle head 14 has an indication 18 for indicating the direction of the ejection nozzle 14.

As shown, a guard 19 which is similar to the tank body 1 in shape, and almost as high as the ejection nozzle head, is rotatably attached around the aerosol ejection head 14. Specifically, the guard 19 is snapped in the neck 20 of the aerosol container 1, thereby preventing the ejection nozzle head 14 from slipping off, still assuring that it can rotate freely. The guard 19 has two open slots 21 made in its long sides.

The guard 19 has a lock projection 22 rising up to the bottom surface 14B of the ejection nozzle head 14. On the other hand, the ejection nozzle head 14 has a lock recess 23 made on its bottom at such a position that the lock projection 22 may be brought in alignment with the lock recess 23 of the ejection nozzle head 14 when the guard 19 is turned to lie across the tank body 1 with either of the opposite slots 21 in alignment with the ejection nozzle 17, thereby permitting depression of the ejection nozzle head 14, and otherwise preventing depression of the ejection nozzle head 14.

Figure 2:
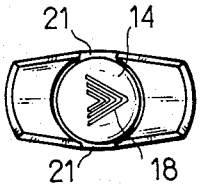
FIG. 2 is a top plan view of the aerosol container in a position in which it cannot eject aerosol, or is locked.
Figure 3:
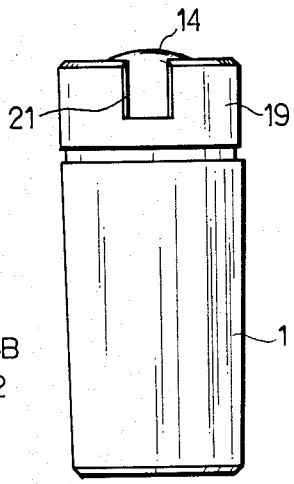
FIG. 3 is front view of the aerosol container in a position in which it is locked.
Figure 4:
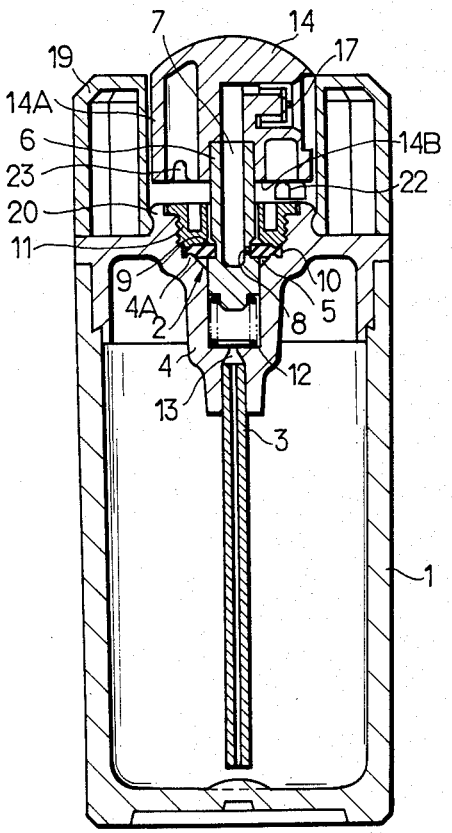
FIG. 4 is a vertical front section of the aerosol container in a position in which it cannot eject aerosol, or is locked.
Figure 5:
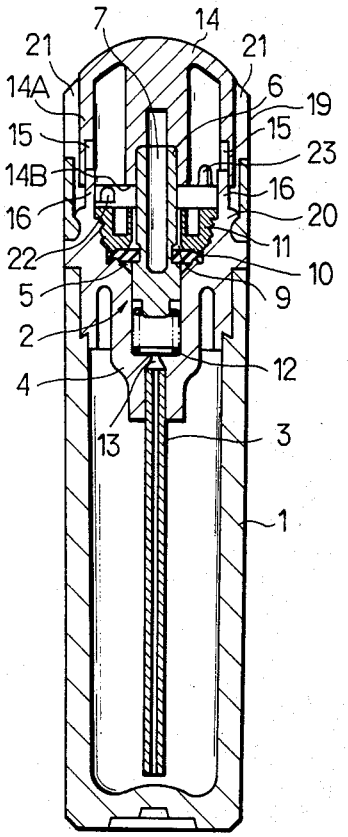
FIG. 5 is a vertical side section of the aerosol container in a position in which it is locked.

Specifically, when the guard 19 is put in alignment with the tank body 1 as shown in FIGS. 2 and 3, the lock recess 23 of the ejection nozzle head 14 is not put in alignment with the lock projection 22 of the guard 19 as shown in FIGS. 4 and 5, so that the bottom of the ejection nozzle head 14 is caught by the lock projection 22, thereby preventing depression of the ejection nozzle head 14 and hence preventing ejection of aerosol.

Figure 6:
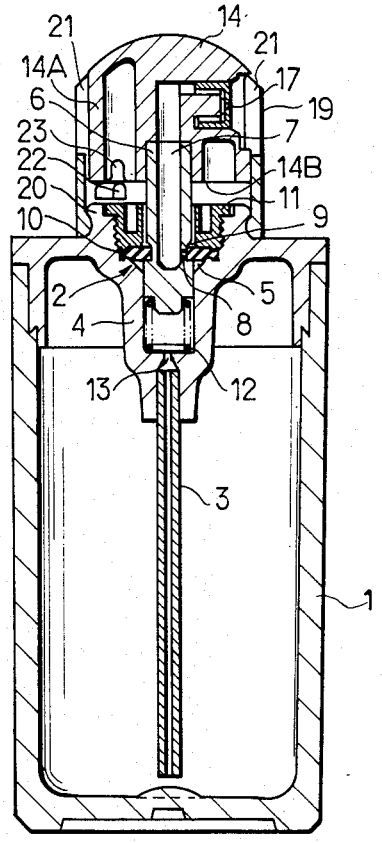
FIG. 6 is a vertical front section of the aerosol container in a position in which it can eject aerosol, or is unlocked.

When the guard 19 is rotated 90 degrees with respect to the tank body 1 as shown in FIG. 1, one of the open slots 21 of the guard 19 is put in alignment with the ejection nozzle 17, and at the same time the lock recess 23 of the ejection nozzle head 14 is put in alignment with the lock projection 22 of the guard 19 as shown in FIG. 6, thereby permitting depression of the ejection nozzle head 14. In this position, if the ejection nozzle 14 is depressed, the aerosol ejection stem 6 is depressed to cause the valve body 10 to bend apart from the valve inlet 8, thus allowing ejection of aerosol from the ejection nozzle 17.

As understood from the above, the guard will lie across the tank body when the aerosol container can force out aerosol in a fine mist, and the guard will lie in alignment with the tank body when the aerosol container cannot eject aerosol. Thus, at first sight it can be readily determined in which position the aerosol container is, locked or unlocked, assuring that it cannot remain inadvertently unlocked, and that when locked it is handy to carry; the guard is put in alignment with the tank body.

I claim:

1. A portable or handy-to-carry, fail-safe aerosol container comprising:

a tank body having, in cross-section, a shape of elongated polygon or oval having relatively long and short cross axes;

an ejection nozzle head having an ejection nozzle built therein and a lock recess opening on the bottom surface thereof, the ejection nozzle being directed parallel to the long axis of the shape of the tank body;

an aerosol ejection stem having a longitudinal channel made therein, being fixed to the ejection nozzle and being slidably fixed to the top of the tank body and spring-biased upward, said aerosol ejection stem when depressed into the tank body, causing an associated valve to open for supplying aerosol to the ejection nozzle; and a guard having the same shape and size in cross-section as the tank body, said guard being rotatably fixed to the top of the tank body about the ejection nozzle head, having a slot on each long side and a lock projection rising up to the bottom surface of the ejection nozzle head at such a position that the lock projection may be brought in alignment with the lock recess of the ejection nozzle head when the guard is turned to lie across the tank body with either of the opposite slots in alignment with the ejection nozzle, thereby permitting depressing of the ejection nozzle head, and hence depression of the aerosol ejection stem until the associated valve has opened for discharging aerosol from the ejection nozzle in a fine mist.

* * * * *